United States Patent [19]

Berry, Jr.

[11] 4,270,514

[45] Jun. 2, 1981

[54] FIREPLACE WITH SLIDING DOORS

[76] Inventor: Clifford D. Berry, Jr., 215 S. Mecca St., Cortland, Ohio 44410

[21] Appl. No.: 44,579

[22] Filed: Jun. 1, 1979

[51] Int. Cl.[3] ..... F24C 15/10

[52] U.S. Cl. ..... 126/140; 126/202; 160/DIG. 9; 49/493

[58] Field of Search ..... 126/120, 138, 139, 140, 126/202; 160/DIG. 9, 209, 33; 16/99, 105; 49/490, 493, 494

[56] References Cited

U.S. PATENT DOCUMENTS

| | | | |
|---|---|---|---|
| 1,093,522 | 4/1914 | Bareuter | 202/248 |
| 1,688,458 | 10/1928 | Eveleth | 49/493 |
| 3,299,575 | 1/1967 | DuShane | 16/99 |
| 3,716,890 | 2/1973 | Benson | 16/99 |
| 4,059,091 | 11/1977 | Cobb | 126/140 |
| 4,183,348 | 1/1980 | Smith | 126/140 |

FOREIGN PATENT DOCUMENTS

| | | | |
|---|---|---|---|
| 667570 | 3/1952 | United Kingdom | 126/202 |

*Primary Examiner*—Samuel Scott
*Assistant Examiner*—Lee E. Barrett
*Attorney, Agent, or Firm*—Brown, Flick & Peckham

[57] ABSTRACT

The wall extending laterally away from the side of a fireplace opening is provided with a vertical recess that receives one end of a track extending across the front of the fireplace below the upper surface of its hearth and supporting a glass door normally located in front of the fireplace but extending part way into the recess, into which it is movable to a retracted position. Mounted between the front surface of the recess and the door is a vertical sealing strip that engages both. A horizontal sealing strip mounted between the door and the front surface of a downwardly opening slot that receives the top of the door engages the door. To help hold the door against the sealing strip there is a rigid horizontal rod mounted in the slot and recess behind the door and engaging the door near its top. A fire screen may be mounted on a track behind the door track.

3 Claims, 7 Drawing Figures

FIREPLACE WITH SLIDING DOORS

U.S. Pat. No. 4,059,091 shows a fireplace with a glass door that can be moved laterally into a recess in the wall while there is a fire in the fireplace. The door includes a metal frame that hangs from rollers traveling on an overhead track. Between the back of the door and the wall around the fireplace opening there are sealing strips. Such an arrangement is not ideal for at least two reasons. The overhead track and rollers and door hangers are exposed to the high temperatures in the fireplace and can be affected deleteriously by them. When there is no fire in the fireplace the closed door will not be drawn tightly against the sealing strips, so the warm air in the room can escape around the door and up the chimney. Also, in such a case the door can chatter against the sealing strips.

It is among the objects of this invention to provide a fireplace with at least one sliding glass door movable along a track located in a position where it is not affected by heat, which is provided with novel means for vertical adjustment, and which effectively seals the front of the fireplace when the door is closed, regardless of whether or not a fire is burning.

The preferred embodiment of the invention is illustrated in the drawings, in which FIG. 1 is a front view of a fireplace with the glass doors closed;

Figure 1:
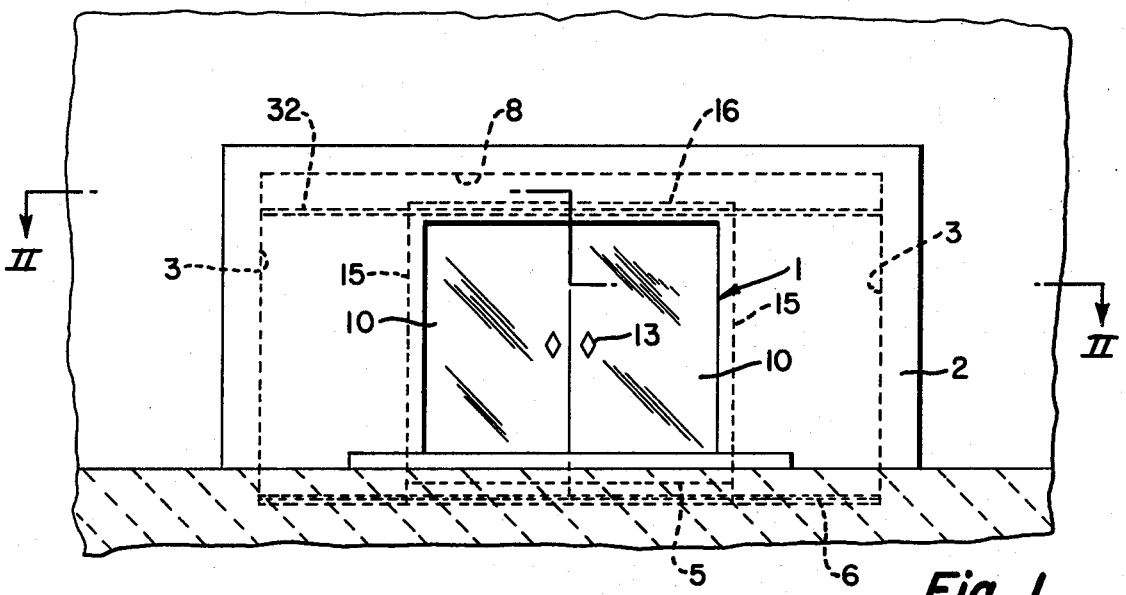
Figure 2:
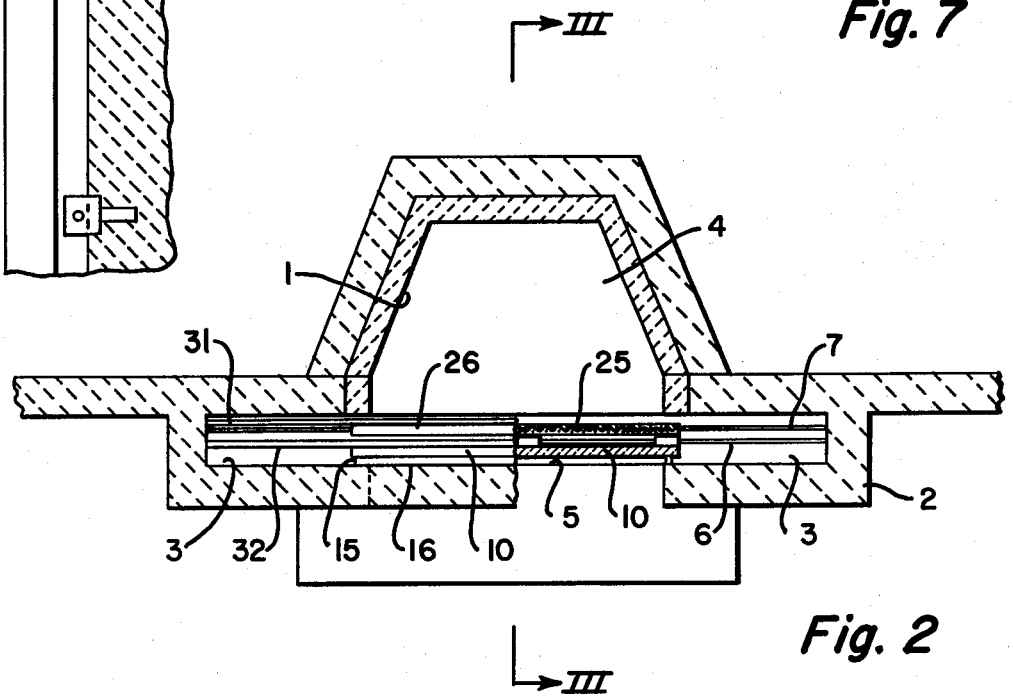
FIG. 2 is a horizontal section taken on the line II—II of FIG. 1.
Figure 3:
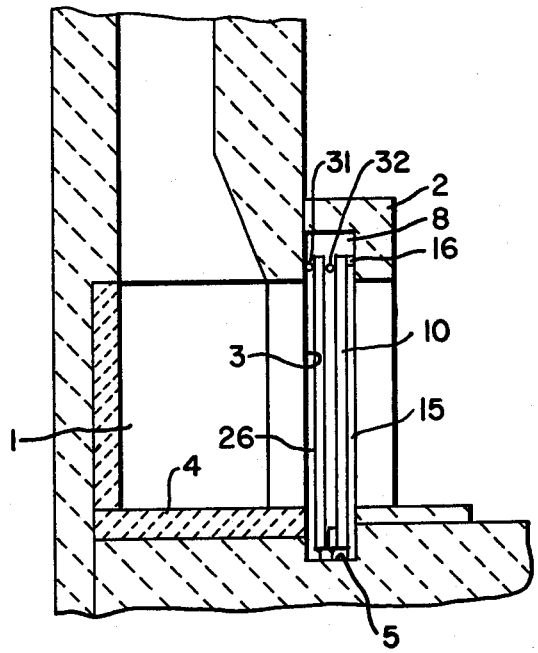
FIG. 3 is a vertical section taken on the line III—III of FIG. 2.

Referring to FIGS. 1, 2 and 3 of the drawings, a typical fireplace 1 is shown, which may be located in any desired wall of a house. The wall 2 surrounding the open front of the fireplace is increased in thickness relative to the rest of the wall in order to be able to accommodate vertical recesses 3 extending laterally away from both sides of the fireplace. Directly in front of the fireplace hearth 4 the floor of the room is provided with a trough-like depression 5 that also extends into the two recesses. Mounted in this depression are two laterally spaced tracks 6 and 7 (FIG. 5) that extend from the inner end of one recess across the fireplace to the inner end of the opposite recess. As shown in FIG. 3, these tracks are located below the level of the surface of the hearth and therefore are in a relatively cool area where they will not be affected by heat from the fireplace. Directly above the tracks the projecting wall is provided with a downwardly opening slot 8 that connects the upper ends of the two recesses.

Figure 4:
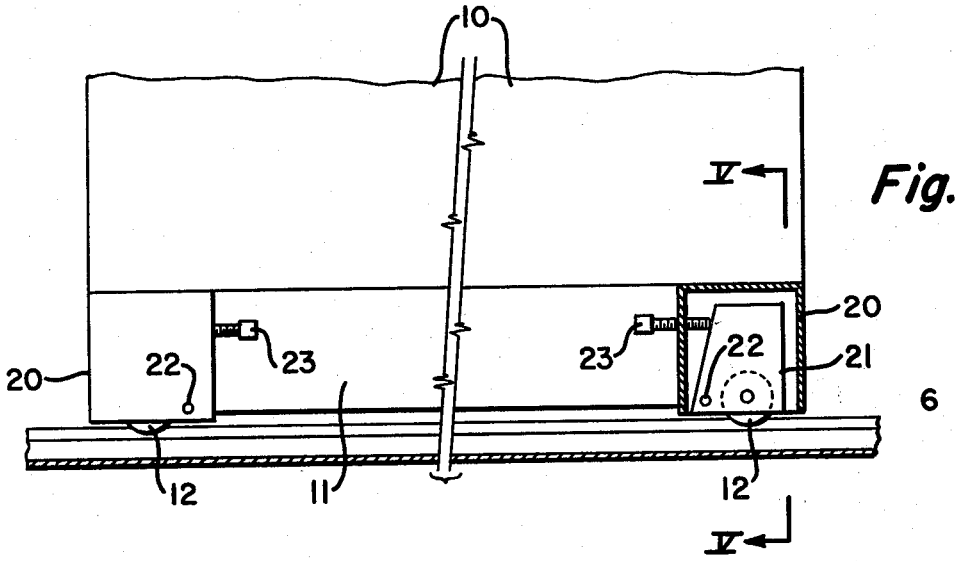
FIG. 4 is an enlarged fragmentary view of the back of a door with part shown in section.
Figure 5:
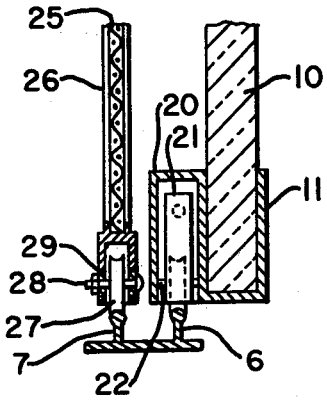
FIG. 5 is a further enlarged vertical section taken on the line V—V of FIG. 4 and also showing a section of the screen behind the door.

Mounted on the outer or forward track 6 is a pair of glass doors that normally meet at the center of the fireplace front opening and extend up into the slot 8 and part way into the side recesses. Each door is formed from a frameless plate 10 of tempered glass. As shown in FIGS. 4 and 5, the bottom of the plate fits in a narrow metal channel 11 extending the full width of the door. This channel is supported by grooved rollers 12 that run on the track so that the door can be moved along it by a knob 13 attached to the door near its outer edge.

Figure 6:
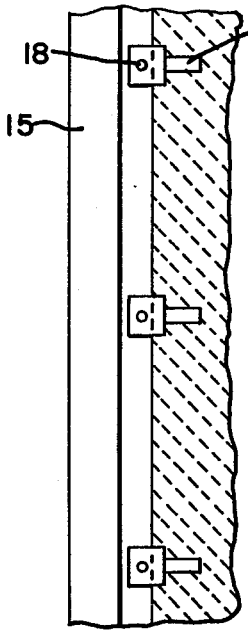
FIG. 6 is an enlarged fragmentary side view of a sealing strip.
Figure 7:
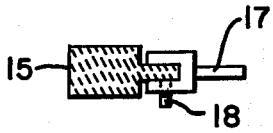
FIG. 7 is a cross section of the sealing strip.

In order to seal the spaces around the door, there is a vertical sealing strip 15 in each recess 3 between the front of the door and the front wall of the recess, and a horizontal sealing strip 16 between the front wall of slot 8 and the front of the top of the door. This upper strip extends from one vertical strip of the other. As shown in FIGS. 6 and 7, each sealing strip is a substantially rigid, but compressible, strip of asbestos, with one longitudinal edge portion compressed to reduce its thickness and further stiffen the strip. The compressed edge of each vertical strip extends into the slotted ends of a plurality of vertically spaced metal connecting members 17 that are anchored in the front wall of the recess. A screw 18 is threaded in one side of each of the slots and presses against the strip to hold it in the slot. The upper horizontal sealing strip 16 is mounted in the same manner.

The glass doors are offset in front of their track, as shown in FIGS. 3 and 5. This is done by providing the back of each end of each supporting metal channel 11 with a metal box 20 that has an open bottom. The rollers 12 project from the bottoms of these boxes, but they are not pivotally connected directly to the boxes. Instead, each roller is pivotally mounted in an openbottom cage 21 inside a box. A lower corner of the cage is connected by a pivot pin 22 to the side wall of the box so that the cage can be adjusted up or down in the box to ensure that the outer ends of the doors will engage flat against each other when the doors are closed, although these outer ends may be provided with gaskets of a suitable material not affected by the heat in the fireplace. As shown in FIG. 4, the vertical adjustment of the cages and the rollers is accomplished by a screw 23 threaded into a box at the same end of the box as pivot pin 22, with the inner end of the screw bearing against the upper part of the cage. If the screw is turned inwardly it will swing the cage down and thereby lower the roller. If the screw is turned outwardly, it will allow the door to move downwardly by gravity relative to the roller. If desired, only one of the rollers on each door need be adjustable. With the rollers housed in the boxes behind the metal channel, the center of gravity of the door is in front of its track so that the door presses forward against the sealing strips at all times.

Mounted on the inner track 7 is a pair of screens, each consisting of a sheet 25 of suitable wire screening mounted in a surrounding metal frame 26. The bottom member of the frame is slotted and contains a grooved roller 27 near each end. Each roller, projecting from the bottom of the frame, is pivotally mounted on a bolt 28 that extends through vertical slots 29 in the opposite sides of the frame and is held in vertically adjustable position by a nut on one end of the bolt. The rollers rest on track 7 so that the screens can be moved from a closed position in front of the fireplace to retracted positions in recesses 3.

To hold the screens upright, there is a rod 31 extending from the inner end of one recess across slot 8 and to the inner end of the other recess. This rod engages the back of the top of the screens. The front of the top of the screens engages another rod 32, which is parallel to rod 31 and located between the screens and glass doors. This rod 32 is large enough to also engage the back of the doors to help hold them against the sealing strips. Before the doors are closed, the screens can be pushed back into the recesses, but when the doors are open and there is a fire in the fireplace the screens are pulled toward each other into engagement in front of the fireplace opening.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A fireplace comprising a heating chamber having a hearth and an open front, a wall extending laterally and upwardly from said fireplace front and also projecting farther forward than the hearth, a horizontal track disposed in front of the hearth below its upper surface, said wall being provided beside the fireplace with a vertical recess extending laterally away from the fireplace in line with said track, the recess being open at its fireplace end and receiving the adjacent end portion of the track, the recess also extending upwardly above the level of the open front of the fireplace, the wall above the fireplace front being provided with a downwardly opening slot extending laterally into the upper end of said recess, a frameless glass door normally located in front of the fireplace and extending up into said slot and part way into said recess, a metal channel receiving the bottom of said door, a pair of rollers on said track spaced lengthwise of said channel, means connected to the back of said channel rotatably supporting the rollers behind it, whereby the door is offset forward of said track, the door being supported by said rollers and movable along the track to retracted position in said recess, a vertical sealing strip mounted between the front surface of said recess and the door in engagement with both, a horizontal sealing strip mounted between the front surface of said slot and the door in engagement with both, the forwardly offset door pressing against said sealing strips, and a rigid horizontal rod mounted in said slot and recess behind the door and engaging the door near its top.

2. A fireplace according to claim 1, including a second track between said first-mentioned track and the hearth and extending into said recess, a fire screen movable along said second track, and a second rigid horizontal rod mounted behind the screen and engaging it near its top, said first-mentioned rod engaging the front of the screen.

3. A fireplace according to claim 1, in which said vertical sealing strip is a substantially rigid but compressible strip of asbestos and one edge portion of the strip is compressed to reduce its thickness and further stiffen it, and a plurality of vertically spaced metal connecting members are disposed along the strip, each connecting member having a slotted end receiving the compressed edge of the strip, a screw threaded in one side of said slotted end and pressing against the strip in the slot to hold it therein, and the opposite end of said connecting member being anchored in the front wall of said recess.

* * * * *